US007462022B2

(12) United States Patent
Fromm

(10) Patent No.: US 7,462,022 B2
(45) Date of Patent: Dec. 9, 2008

(54) ROTARY DISPLACEMENT PUMP COMPRISING SCRAPER AND GUIDE OF THE SCRAPER

(75) Inventor: Ulrich Fromm, Untergruppenbach (DE)

(73) Assignee: Maso Process-Pumpen GmbH, Ilsfeld (DE)

( * ) Notice: Subject to any disclaimer, the term of this patent is extended or adjusted under 35 U.S.C. 154(b) by 0 days.

(21) Appl. No.: 11/575,529

(22) PCT Filed: Sep. 16, 2005

(86) PCT No.: PCT/EP2005/010006

§ 371 (c)(1),
(2), (4) Date: Mar. 19, 2007

(87) PCT Pub. No.: WO2006/032415

PCT Pub. Date: Mar. 30, 2006

(65) Prior Publication Data

US 2007/0297930 A1 Dec. 27, 2007

(30) Foreign Application Priority Data

Sep. 20, 2004 (EP) ..... 04022323

(51) Int. Cl.
*F03C 4/00* (2006.01)
*F04C 2/00* (2006.01)

(52) U.S. Cl. ..... 418/216; 418/152; 418/179; 418/219

(58) Field of Classification Search ..... 418/125, 418/127, 216, 217, 219, 221–223, 228, 229, 418/243, 242, 152, 179
See application file for complete search history.

(56) References Cited

U.S. PATENT DOCUMENTS

| | | | | | |
|---|---|---|---|---|---|
| 1,509,051 | A | * | 9/1924 | McBryde | 418/244 |
| 1,654,883 | A | | 1/1928 | Jaworowski | |
| 1,690,728 | A | * | 11/1928 | Jaworowski | 418/216 |
| 2,788,748 | A | * | 4/1957 | Szczepanek | 418/158 |
| 3,156,158 | A | * | 11/1964 | Pamplin | 418/217 |
| 3,194,167 | A | * | 7/1965 | Wilson | 418/179 |
| 3,769,945 | A | * | 11/1973 | Kahre | 418/217 |
| 4,575,324 | A | * | 3/1986 | Sommer et al. | 418/217 |
| 5,980,225 | A | | 11/1999 | Sommer | |

FOREIGN PATENT DOCUMENTS

DE 4218385 A1 11/1993

OTHER PUBLICATIONS

International Search Report and Written Opinion for International Application No. PCT/EP2005/010006 mailed on Nov. 30, 2005.

* cited by examiner

*Primary Examiner*—Theresa Trieu
(74) *Attorney, Agent, or Firm*—Carlson, Gaskey & Olds

(57) ABSTRACT

A rotary displacement pump includes a stator (42) fixed in a housing (20), a rotor including a shaft portion (8), a radially protruding web (12), a scraper (110) having an engagement slot (112) engaging the protruding web (12). A guide (92) retains the scraper (110) in a circumferential direction and allows the scraper (110) to move reciprocatingly in a substantially axial direction. The scraper includes first, second and third grooves (120, 124 and 127). The grooves are designed so that they accommodate a portion of the guide (92) and allow the reciprocating movement of the scraper (110).

13 Claims, 7 Drawing Sheets

ROTARY DISPLACEMENT PUMP COMPRISING SCRAPER AND GUIDE OF THE SCRAPER

FIELD OF THE INVENTION

The present invention relates to a rotary displacement pump of a type known as "sine pump" (the company MASO Process-Pumpen GmbH, 74358 Illsfeld, Germany, designates, since a number of years, those pumps produced and sold by the company as "sine pumps"). A pump of this type comprises a rotatable disk that has an undulatory configuration (i.e. at least one front surface of the disk does not form a plane perpendicular to the axis of rotation of the disk, but has a periodically varying distance from a virtual middle plane of the disk, when going along a circumferential path about the axis of rotation). The disk, more precisely a radially protruding web of the rotor, engages a scraper that is retained in circumferential direction of the pump and is free for reciprocating movement in a substantially axial direction of the pump, thereby "following" the axially oscillating motion of the web. At one side of the scraper, i.e. the suction side of the pump, "chambers" are opened and gradually increase in size due to the rotation of the rotor. At the other side of the scraper, i.e. the pressure side of the pump, those "chambers" gradually decrease in size due to the rotation of the rotor, since the material contained in the chamber is hindered by the scraper to move on along a circular path.

Pumps of this type are known in the art. They are suitable for a wide range of applications, but the most prominent field of application is pumping flowable, relatively viscous materials in the food stuff industry, the chemical and biochemical industry, the medical industry and the cosmetic industry. Yoghurt, soup, sauce, mayonnaise, fruit juice, cheese material, chocolate, paint, cosmetic creme, lipstick material may be mentioned as a small selection of materials which can be pumped by means of the pump according to this invention.

BACKGROUND OF THE INVENTION

Sine-type pumps and sine-type motors (designed like pumps, but using a pressurized fluid to generate drive torque) are known in a variety of constructions.

U.S. Pat. No. 3,156,158 discloses a dental drilling apparatus comprising a sine-type motor. The housing of the motor has a hollow cylindrical configuration. A stator is disposed in the housing to be in contact with the outer circumferential surface of the web of the rotor for about 180°. The stator has a generally sleeve type configuration, but does not extend a full 360° circle and includes an axially extending, interrupting slot to retain the scraper by such slot. Sealing of the motor against leakage of the working fluid is effected by sealing rings placed near the axial end portions of the housing, relatively distant from the rotor web and the inlet and outlet ports.

The company MASO Process—Pumpen GmbH, 74358 Illsfeld, Germany, has produced and sold for a number of years a sine—pump having a stator extending somewhat more than 180° along the inner circumference of the housing. The portions of the housing, forming the inlet and outlet chambers, are not lined with the stator. The scraper is supported in the housing by means of a complicated support member. Seen in axial direction, the support member is inverted U-shaped and saddles the block-shaped scraper. The support member requires complicated machining.

It is an object of the invention to provide a sine-pump that allows relatively uncomplicated and inexpensive manufacture.

DISCLOSURE OF THE INVENTION

According to the invention, the rotary displacement pump comprises:

(a) a housing (20);

(a) a stator (42) fixed in said housing (20);

(c) a rotor including a shaft portion (8) and a radially protruding web (12) having a configuration of an undulatory disk type;

(d) a scraper (110) having an engagement slot (112) of predetermined radial height and predetermined axial width, the engagement slot (112) engaging said protruding web (12) of said rotor;

(e) a guide (92) of said scraper (110), the guide (92) generally having a configuration of a recessed plate and being—directly or indirectly—fixed in said housing (20), wherein the guide (92) retains said scraper (110) in circumferential direction and allows said scraper (110) a reciprocating movement in substantially axial direction;

(f) said scraper (110), in addition it said engagement slot (112), including a first groove (120) having a predetermined depth and extending along its radially outer edge surface, and a second groove (124) and a third groove each having a predetermined depth and extending in radial direction along one front edge surface and along another front edge surface, respectively, of said scraper (110), said three grooves (120, 124) being designed such that they accommodate a portion of said guide (92) and allow said reciprocating movement of said scraper (110) in said substantially axial direction;

(g) and said housing (20) together with said stator (42) and together with said scraper (110) defining an inlet chamber (138), having an inlet port (68), of said pump (2), an outlet chamber (142), having an outlet port (70), of said pump (2), and a channel (140) extending from said inlet chamber (138) to said outlet chamber (142), said scraper (110) forming a partition between said inlet chamber (138) and said outlet chamber (142), and said web (12) of said rotor being rotatable through said inlet chamber (138), said channel, said outlet chamber (142) and said engagement slot (112) of said scraper (110).

The radially protruding web (or "undulatory disk") may be an integral part of the rotor. More preferably, however, the disk is a workpiece machined separately from the shaft portion of the rotor and secured to the shaft portion after machining. The shaft portion and the disk portion are normally formed of metal.

Preferably, one front face or both front faces of the disk follow exactly or approximately a mathematical sine curve when scanning the web face in circumferential direction (as seen in radial direction towards the centre of the rotor). Preferably, the web describes two complete sine line periods in its 360° "circle", so that there are two chambers at each side of the web, all together four chambers at 90° distances along the 360° circle. However, any other kind of undulatory configuration for example comprising curvatures having constant radii rather than curvatures according to a sine curve, are feasible as well. The radii of curvature should not be too small, in order to facilitate co-operation with the scraper.

The engagement slot of the scraper has such a shape that it can engage the web of the rotor, even though the web is not plane. As a consequence, there are curved transitions both at the entrance side and at the exit side of the scraper and at both sides of the web. At the radially inner end of the slot there is normally a curved transition into the radially inner face of the scraper, adapted to the curved transition between the respective face of the web and the adjacent cylindrical surface of the hub of the disk.

The guide of the scraper, generally has a configuration of a recessed plate. A recessed plate is much easier and cheaper to manufacture than the complicated workpiece provided in conventional sine pumps of the company MASO Process-Pumpen, preferably by laser cutting. One option to indirectly fix the guide in the housing is to fix the guide in the stator. The guide is preferably made of metal.

Preferably, the recess of the guide has a rectangular shape, and the first groove, the second groove, and the third groove of the scraper engage the three margins of the guide adjacent the recess of the guide.

Preferably, the guide is fixed in said housing by means of several pin heads engaging an edge zone of said guide at both faces. The pins may be screw pins. The pin heads may be wider than the pin shafts, but this must not be the case. The pins may be directly fastened to the housing proper, but alternatively may be fastened to the stator. As an alternative, the guide may be fixed to the stator by at least part of its edge zones resting in grooves of the housing or of the stator. At those sections of the guide where it contacts the housing or the stator, the design should be such that substantially no pumped material is allowed to pass from the outlet chamber back to the inlet chamber. In some cases exact dimensioning is sufficient, in other cases providing a sealing element or sealing elements is better.

The housing preferably consists of the following main parts: A cylindrical body, two circular end plates, two pipe sockets; the rest are auxiliary parts such as screws, securing pins, etc. The main parts preferably are of metal. Stainless steel is a well suited material, but other metals which are not corroded by the material to be pumped are suitable as well. It is possible to use a tube shaped workpiece for the body of the housing, just a minimum of machining the inner circumference and the two front faces is required. The end plates too require a minimum of machining. Typically the two pipe sockets are welded to the body of the housing which, of course, has two radial openings so that the pumped material may flow from the inlet pipe socket into the interior of the housing and from there into the outlet pipe socket.

Preferably, the stator comprises two stator members abutting in a plane that is perpendicular to a rotor axis. The stator or the stator members may be moulded in such a precision that no subsequent machining is required. As an alternative, machining after moulding may be provided.

Preferably the stator is formed of plastic material, more preferred duroplastic resins. Polyamide is particularly preferred due to its high strength, its small thermal expansion, and its low moisture absorption. Other suitable plastics materials exists, for example Polyetheretherketone (PEEK). What has been said about the material of the stator also applies for the preferred materials for the scraper. It is not mandatory that the stator and the scraper consist of the same material.

It is possible to design the stator as to include a generally cup shaped first member and a generally cup shaped second member, and as defining a circumferential wall. In the following paragraphs, preferred features and embodiments of the invention will be disclosed, which have to do with the provision of two generally cup shaped stator members and the way how the two stator members are sealed in relation to the housing or in relation to each other:

The language "generally cup shaped member" is intended to describe very generally the overall configuration of the stator member. The said language does not mean that the bottom of the "generally cup shaped member" is substantially flat and closed (as it is the case with most of the drinking cups). An embodiment of the invention shown in the drawings will demonstrate the intended broad meaning of "generally cup shaped". Preferably, the stator consists of two cup shaped members and includes no additional members (auxiliary elements such as sealing elements or fastening elements not considered).

Preferably, the first stator member and the second stator member abut each other in a first abutment area having a configuration of a circular arc (typically about 160° to 210° long, depending on the sizes of the inlet port and of the outlet port) and in a second abutment area having a configuration of a circular arc (typically 10° to 60° long). Preferably, the inlet port is formed by a pair of first recesses in the circumferential walls of the first and second stator members. Each recess may have a substantially semicircular shape when seen in radial direction. The outlet port may be formed in an analogous way.

Sealing of the stator members against leakage of pumped material into the (typically narrow) space between the housing and the stator preferably is effected close to the abutment areas and close to the inlet and outlet ports, in order to keep small the area of the housing contaminated by the pumped material. One preferred design is to provide a first sealing member (preferably an O-ring) at the first stator member, extending at a small distance substantially parallel to the abutments areas and the inlet and outlet ports, and to provide a second sealing member in an analogous way at the second stator member. Grooves for accommodating the sealing members may be formed in the outer surfaces of the circumferential walls of the stator members, preferably at the same time when the stator members are moulded.

A second preferred design is to provide one unitary moulded sealing member placed in grooves provided in said first and second abutment areas and in grooves provided in the outer surfaces of the circumferential walls substantially parallel to the inlet and outlet ports.

A third preferred design is to provide one unitary moulded sealing member placed in grooves provided in said first and second abutment areas and in grooves provided in the walls of said inlet and outlet ports. Those sections of the unitary moulded sealing member, which are located in the grooves provided in the walls of said inlet and outlet ports, would engage the outer cylindrical surface of the respective pipe socket.

The second preferred sealing design and the third preferred sealing design may be modified in the way that the unitary moulded sealing member is replaced by four sealing members, one for the length of the first abutment area, one for the length of the second abutment area, and two surrounding the inlet and outlet ports, respectively (either located in a groove in the outer cylindrical surface of the stator or being placed in grooves of the walls of the inlet and outlet ports).

Sealing between the stator and the pipe sockets alternatively may be effected by sealing rings located in circumferential grooves of the pipe sockets. This alternative may be practiced either with isolated sealing rings or with the corresponding sections of the unitary moulded sealing member.

Preferably, the rotor is not supported by bearings positioned in the stator or the housing, but supported by bearings positioned besides the stator or the housing. The entire pump (not considered its drive motor, typically an electric motor) preferably comprises a support part accommodating the bearings of the rotor, and the housing being secured to said support part.

It is stressed, that the invention relates not only to the pump in its entirety, but also to constituents thereof. In particular, the stator as disclosed herein is a further subject-matter of the invention, the guide as disclosed herein is a further subject-matter of the invention, the scraper as disclosed herein is a further subject-matter of the invention, the guide plus scraper assembly as disclosed herein is a further subject-matter of the invention, the various seals and sealing members as disclosed herein are a further subject-matter of the invention.

BRIEF DESCRIPTION OF THE DRAWINGS

The invention will be elucidated in more detail, referring to embodiments described in the following and shown in the accompanying drawings.

FIG. 1 shows an entire pump 2 comprising a pump part 4 or pump proper 4 and a support part 6. The pump proper 4 will be described in more detail, referring to FIG. 2 to 9. The support part 6 will be described further below. At the right-hand side of FIG. 1, an end portion of a shaft 8 protrudes from the support part 6. A drive motor, not shown, typically an electric motor, serves to apply torque to the shaft 8, either by being directly or through a coupling coupled to the shaft 8 or for example through a gear or a pulley etc.

Referring now to FIG. 4, one can see the left-hand portion of the shaft 8. A disk member 10 is keyed to the shaft 8 and rotates with the shaft 8. In the following, the disk member 10 will be referred to as "disk 10". The shaft 8 and the disk 10 are part of a rotor.

Figure 1:
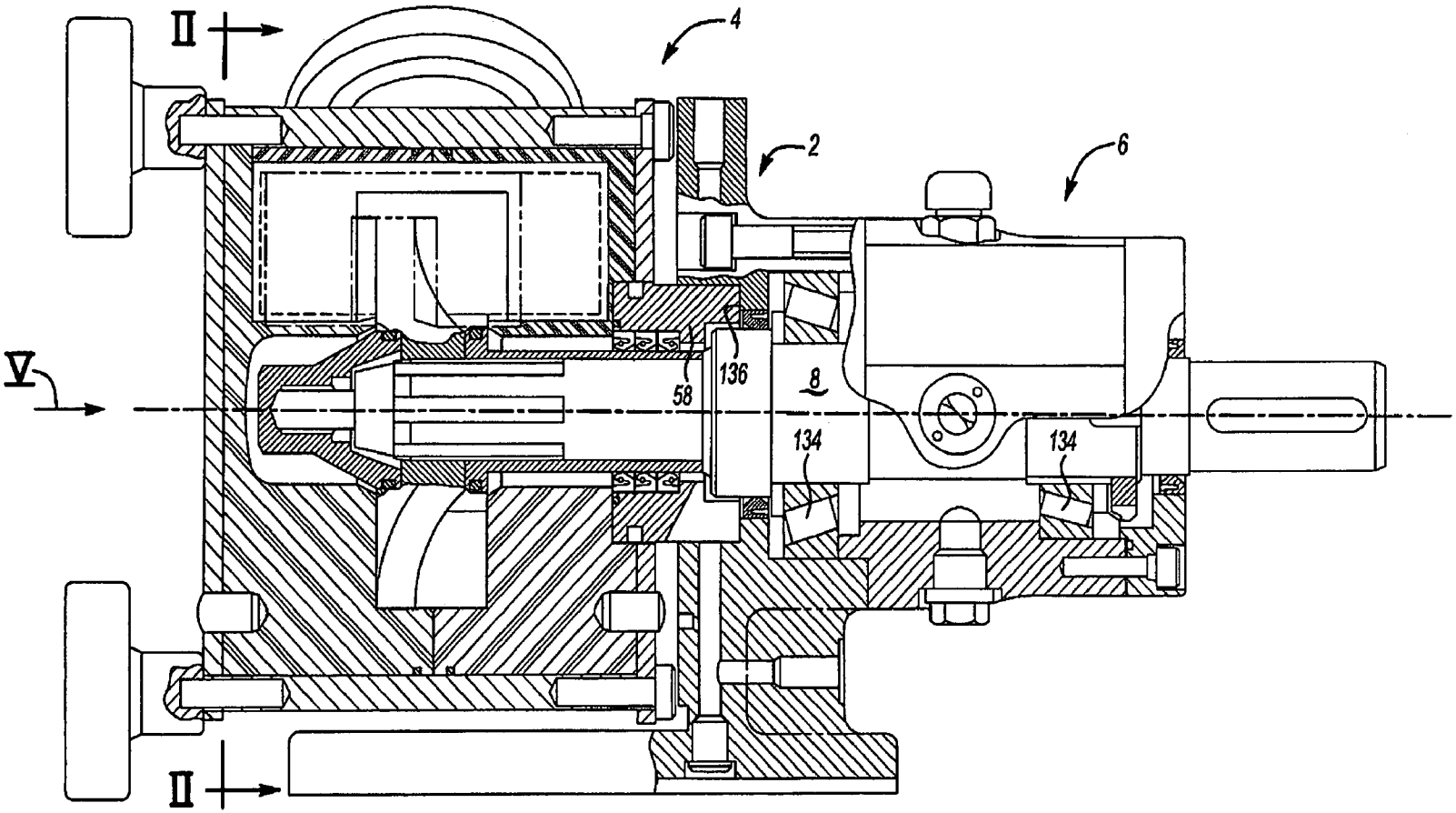
FIG. 1 shows a complete pump, in a side elevation view, partially in axial section.

The disk 10 comprises a radially protruding web 12. The web 12 has an axial thickness 14 and a predetermined outer diameter. The web has a right-hand (front) surface 16 and a left-hand (front) surface 18. If one follows, for example with a finger tip and for example along the circle line of the outer diameter, the surface 16, the finger tip will describe a curved sinus-type line seen in radial view (not necessarily in the strict mathematical sense), undulating with respect to a middle plane intersecting the axis of the shaft 8 at a right angle. Along a 360° circle there are two full periods of the sine curve, i.e. a first time from completely left-hand in FIG. 4 to completely right-hand in FIG. 4 and back, and a second time from completely left-hand in FIG. 4 to completely right-hand in FIG. 4 and back. The same description as made with respect to the right-hand face 16 applies to the left-hand face 18.

The pump proper 4, in the following referred to simply as "pump 4", comprises a housing 20 having the following main parts: A tubular cylindrical body 22, a right-hand, circular, first end plate 24, a left-hand, circular, second end plate 26, an inlet pipe socket 28 (cf FIG. 2), and an outlet pipe socket 30 (cf FIG. 2). In addition, there are three screws 32 at 120° intervals to secure the end plate 24 to the body 22, three screws 34 with hand knobs 36 at 120° intervals to secure the end plate 26 to the body 22, and axially extending holding pins 38 to be described later. The pipe sockets 28, 30 are welded to the body 22 (not shown) and have threads (not shown) at their radially outer end portions to allow the connection of external tubing. The axes of the two pipe sockets 28, 30 intersect at 90°. The body 22 has two openings 40 corresponding to the pipe sockets 28, 30.

The body 22, the end plates 24, 26, and the pipe sockets 28, 30 consist of stainless steel.

Figure 4:
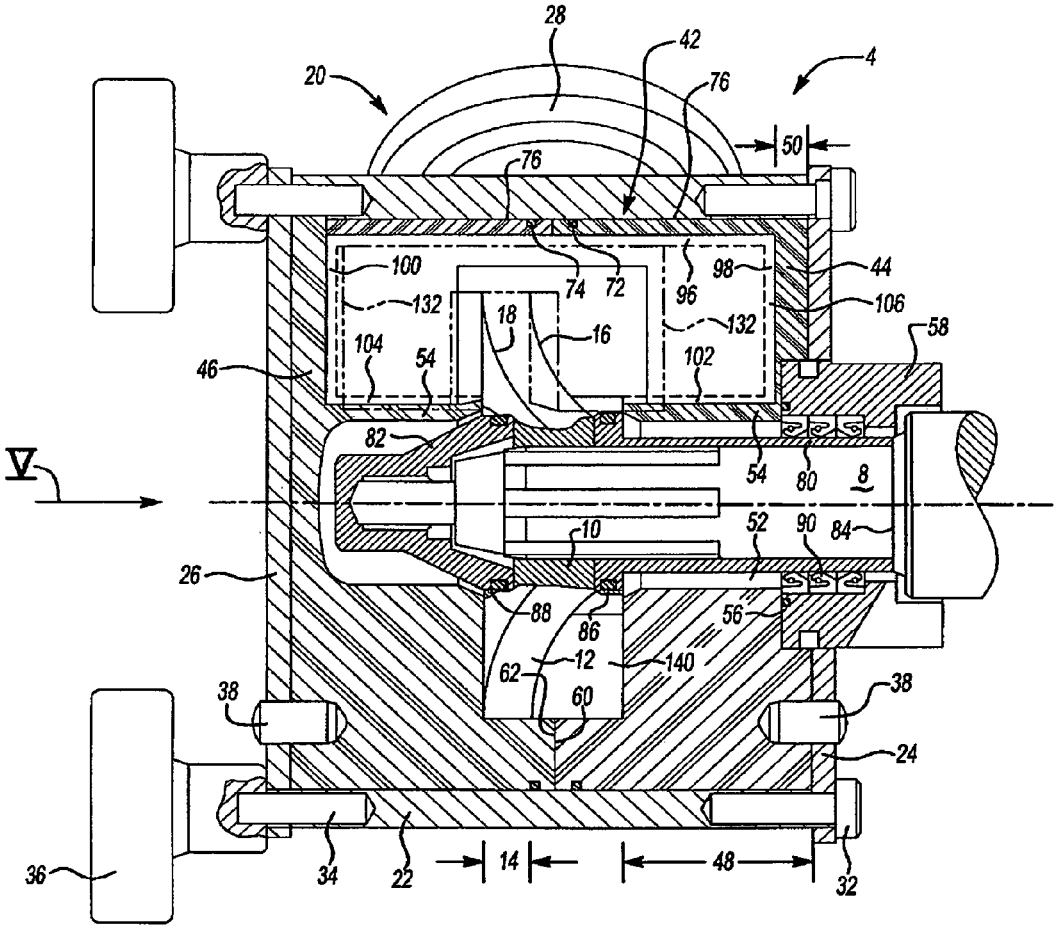
FIG. 4 shows the pump part proper of the pump of FIG. 1, in an axial section and on a larger scale than FIG. 1.
Figure 5:
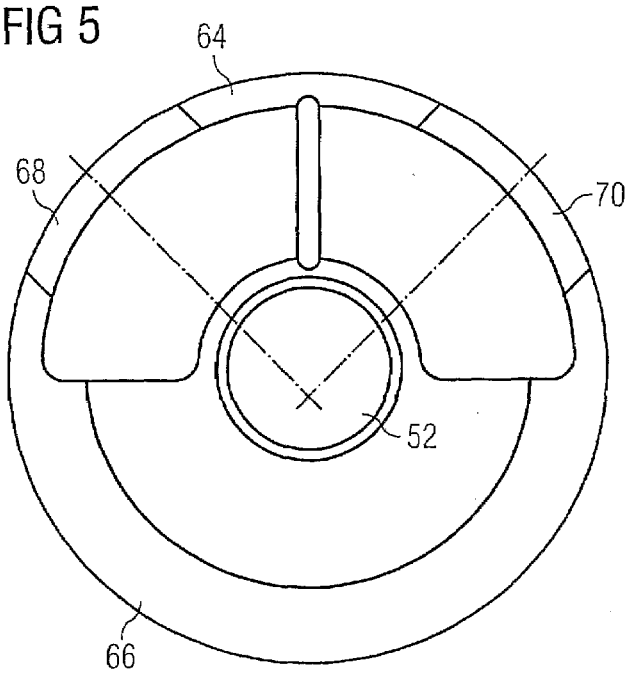
FIG. 5 shows a first stator member, in a front elevation view in the direction of arrow V in FIG. 1.

A stator 42 lines completely the inner surface of the housing 20. The stator 42 consists of a generally cup shaped first stator member 44 (right-hand in FIG. 4) and a generally cup shaped second stator member 46 (left-hand in FIG. 4). FIG. 5 shows the first stator member 44, seen in the direction of arrow V in FIG. 4.

The first stator member 44 has, in its lower portion (constituting approximately the lower half of the first stator member 44) a substantially larger thickness 48 of its bottom wall than the thickness 50 in the upper portion thereof. The first stator member 44 comprises, in its central portion, a cylindrical opening 52 that is confined in its lower portion by the thick bottom wall and it its upper portion by a cylindrical wall 54. The bottom wall of the first stator member 44 is plane at its right-hand front face. The left-hand front face of the first stator member 44 is also plane.

Generally speaking, the second stator member 46 is mirror-image to the first stator member 44, with the most relevant exception that there is no central opening 50, but a completely closed bottom wall. Another relevant exception is a circular recess 56 in the right-hand front face of the first stator member 44. The recess 56 accommodates the end portion of an outer distance sleeve 58.

The left-hand front face 60 of the first stator member 44 and the right-hand front face 62 of the second stator member 46 abut each other. There is an actual, upper, first abutment area 64, about 400 "long", and an actual, lower, second abutment area 66, about 200° "long". There is an inlet port 68 of the stator 42 between the first abutment area 64 and the second abutment area 66, and an outlet port 70 of the stator 42 between the second abutment area 66 and the first abutment area 64. The inlet and outlet ports 68, 70 are circular in radial view and correspond in diameter and position to the openings 40 in the body 22 of the housing 20. However, the inlet and outlet ports 68, 70 may have a smaller size or a bigger size than the openings 40.

The holding pins 38 mentioned hereinbefore, serve to retain the first and second stator members 44, 46 against rotation by fixing them with respect to the end plates 24, 26 of the housing 20. The first and second stator members 44, 46 are clamped against each other between the end plates 24, 26 of the housing 20.

Figure 3:
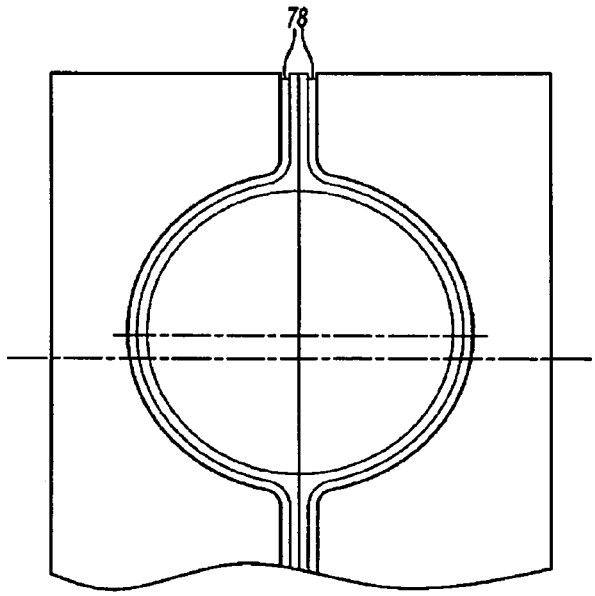
FIG. 3 is a radial view in the direction of arrow III in FIG. 2 of a stator of the pump of FIG. 1.

A first sealing member 72 and a second sealing member 74, each in the form of an O-ring, serve to seal the stator members 44, 46 against leakage of the pumped material into the space 76 (narrow gap) between the stator 42 and the housing 20. In the portions of the first stator member 44 where there is no inlet port 68 or outlet port 70, the first sealing member 72 is provided at the outer circumference of the first stator member 44, close to the first and second abutment areas 64, 66. In the portions of the first stator member 44 where there are the inlet port 68 or the outlet port 70, the first sealing member 72 is also provided at the circumferential wall, but follows the semi-circle of the inlet port 68 and the semi-circle of the outlet port 70 at a small distance. The same description applies analogously to the second sealing member 74 provided at the outside of the circumferential wall of the second stator member 46. The first sealing member 72 and the second sealing member 74 are each placed in a groove 78. FIG. 3 illustrates the grooves 78 and the way how the sealing members 72, 74 encircle the stator members 44, 46.

The hub of the disk 10 is clamped in axial direction against an inner distance sleeve 80 by means of a threaded nut 82. The right-hand front face of the inner distance sleeve 80 abuts against a shoulder 84 of the shaft 8. The hub of the disk 10 has a right-hand front face 86 that is in sliding contact with the first stator member 44, and has a left-hand second front face 88 that is in sliding contact with the second stator member 46. Those sliding contacts provide for a certain sealing effect. Complete sealing is effected by lip sealing rings 90 located between the stationary outer distance sleeve 58 and the rotating inner distance sleeve 80. Sliding ring seals may be used as an alternative.

The axially most protruding portions of the right-hand front face 16 of the web 12 and the axially most protruding portions of the left-hand front face 18 of the web are in contact (in form of a radial contact line) with the stator 42.

Figure 6:
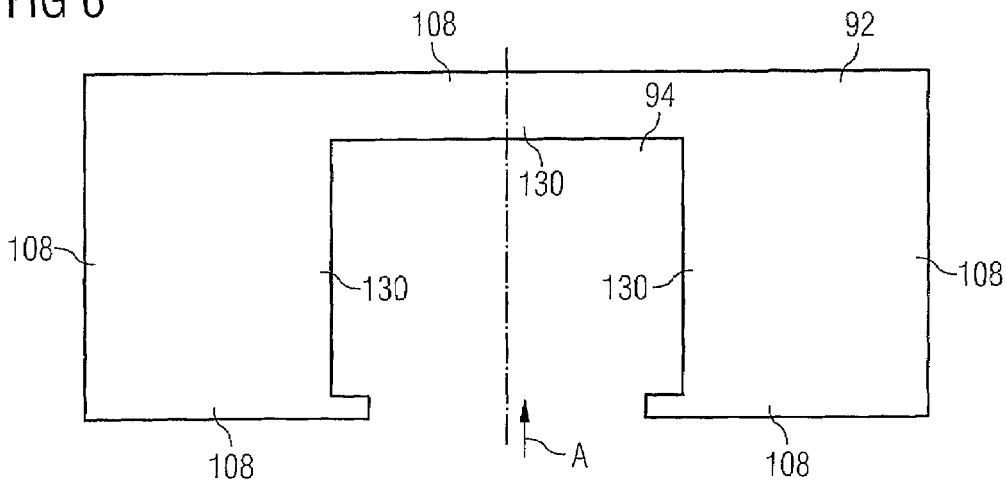
FIG. 6 shows a guide of a scraper, in a side elevation view and on a larger scale than in FIG. 1.

FIG. 6 shows a guide 92 on a larger scale. The guide 90 is a rectangular metal plate with a generally rectangular recess 94 in its middle portion. The guide 92 is fixed in the stator 42 by means of grooves in the stator members 44, 46. There is an axially extending groove 96 in the inner surface of the circumferential walls of the stator members 44, 46. There is a radially extending groove 98 at the inner side of the bottom wall of the first stator member 44. There is a radially extending groove 100 in the inner surface of the bottom wall of the second stator member 46. There is an axially extending groove 102 in the wall 54 of the first stator member 44. And there is an axially extending groove 104 in the corresponding wall 54 of the second stator member 46. All those grooves 96, 98, 100, 102, 104 lie in the same plane. They are shown by interrupted lines 106. In the assembled state, shown in FIG. 4, the guide 92 extends with all its four edge zones 108 (i.e. the long edges and the short edges of the rectangular plate) into the grooves 96, 98, 100, 102, 204. In this way the guide 92 is fixed in both axial directions, in both radial directions and in circumferential direction.

Figure 7:
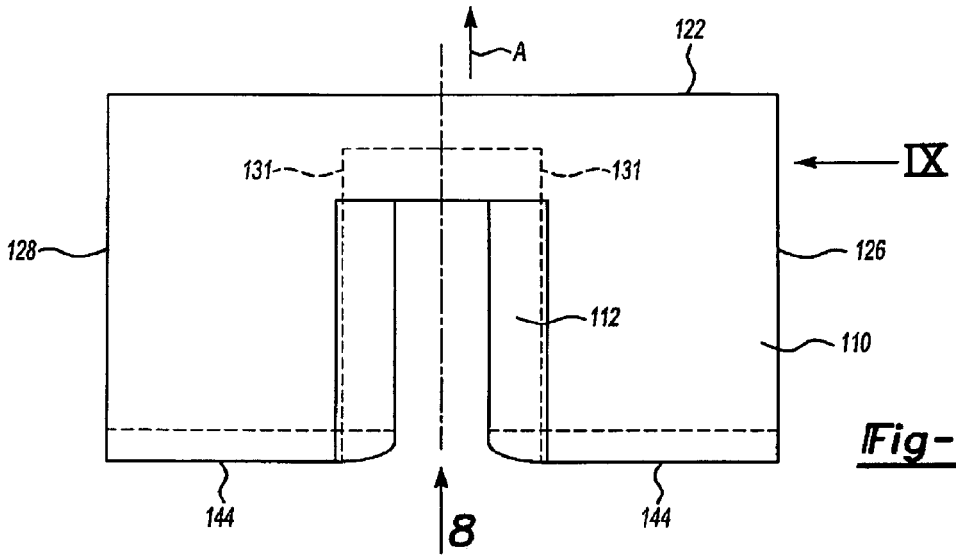
FIG. 7 shows a scraper, in a side elevation view and on a larger scale than in FIG. 1.
Figure 8:
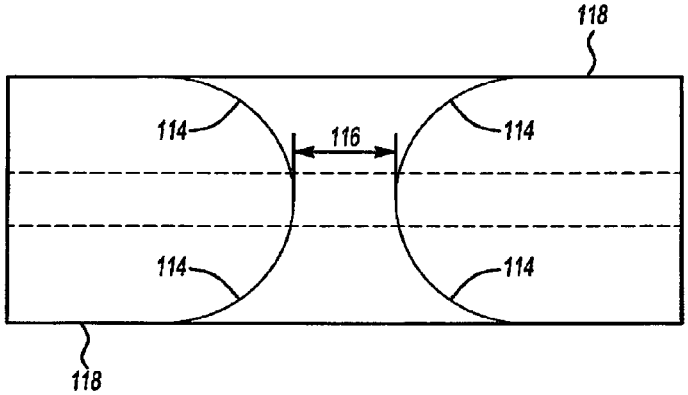
FIG. 8 shows the scraper of FIG. 7, seen in the direction of an arrow VIII in FIG. 7.
Figure 9A:
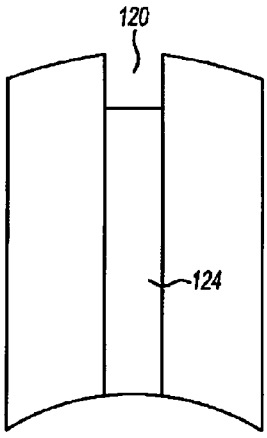
FIG. 9A shows the scraper of FIG. 7, seen in the direction of an arrow IX in FIG. 7
Figure 9B:
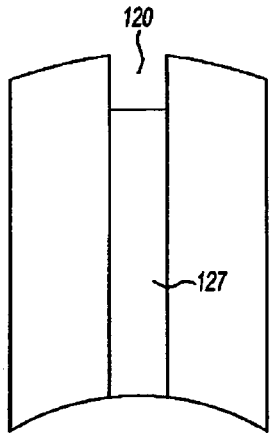
FIG. 9B shows the scraper from an opposite side.

FIGS. 7, 8, 9 show a scraper 110. The scraper 110 has generally the configuration of a rectangular plate, but having an engagement slot and various grooves to be described hereinbelow. The scraper 110 is about five times as thick as the guide 92. The guide 92 and the scraper 110 have a common central plane.

The scraper 110 has a crossing engagement slot 112 that extends, generally speaking, in circumferential direction. When looking into the engagement slot 112 in a radially outward direction (cf FIG. 8), one can see that there are four curved transitions 114 between the narrowest portion 116 of the engagement slot 112 and the large area flat surfaces 118 (facing in both circumferential directions) of the scraper 110. The axial dimension 116 of the engagement slot 112 at its smallest portion is just a little wider than the axial dimension 14 of the web 12 of the impeller disk 10, so that the engagement slot 112 can be placed over the web 12, the scraper 110 straddling the web 12. The curved transitions 114 take into account the curved or undulatory configuration of the web 12 as contrasted to a plane configuration.

The scraper 110 further has a first groove 120 that extends along its radially outer edge surface 122. The scraper 110 further has a second grove 124 that extends in radial direction along one front end surface 126. The scraper 110 further has a third groove 127 that extends in radial direction along its other front end surface 128. All three grooves 120, 124 and 127 have predetermined depths (the radially extending grooves 124 and 127 being much deeper than the first groove 120) and have a width just a little wider than the thickness of the guide 92. In order to assemble the scraper 110 and the guide 92, the scraper 110 may be slid over the guide 92 in the direction of the arrow A (shown in FIGS. 6 and 7). In the assembled situation, the scraper 110 "fills" the recess 94, leaving of course open the engagement slot 112. The three grooves 120, 124 and 127 accommodate the three edge zones 130 or margins along the recess 94 of the guide 92, so to say in a sandwich-like manner The radially extending edge zones 130 of the guide 92 and the bottom surfaces 131 of the radially extending second and third grooves 124 and 127 of the scraper 110 have such a distance from each other that the scraper 110 can follow, in both axial directions, the undulations of the impeller disk 10. In FIG. 4, the radial lines 132, drawn as "line dot dot line dot dot etc", illustrate the front edge surfaces 126, 128 of the scraper 110. The situation shown in FIG. 4 is the left-hand extreme position of the scraper 110.

Referring again to FIG. 1, it is described now how the rotatable shaft 8 is supported in the support part 6. There are two angular roller bearings positioned at a distance within the support part housing. The inner races of the roller bearings 134 are secured to the shaft 8. The shaft 8 protrudes in the left-hand direction out of the support part 6 and extends in cantilever fashion into the pump proper 4. The outer distance sleeve 58 abuts, at its right-hand front face, against a positioning face 136 of the support part 6. The housing 20 of the pump proper 4 is secured in axial direction against the support part 6 by three screws at 120° intervals (not shown).

In order to assemble the pump proper 4 with the support part 6 and the shaft 8 protruding from the support part 6, the outer distance sleeve 58 is inserted first, then the three lip sealing rings 90. Then an assembly of first end plate 24, right holding pin 38, first stator member 44 and body 22 is slid over the outer distance sleeve 58; thereafter the inner distance sleeve 80 is inserted. Then, at a separate location, the scraper 110 and the guide 92 are put together in the direction of the arrow A, as described hereinbefore, and such "sandwich" is placed over the web 12 of the disk 10. Thereafter, the disk 10, including the scraper 110 and the guide 92, is slid in axial direction over the left-hand end portion of the shaft 8, three edge zones 108 of the guide 92 reaching into the grooves 96, 98, 102 of the first stator member 44. Next, the nut 82 can be put in place and tightened. Thereafter, the second stator member 46 and the left holding pin 38 and the second end plate 26 are put in place. The screws 34 are tightened.

Figure 2:
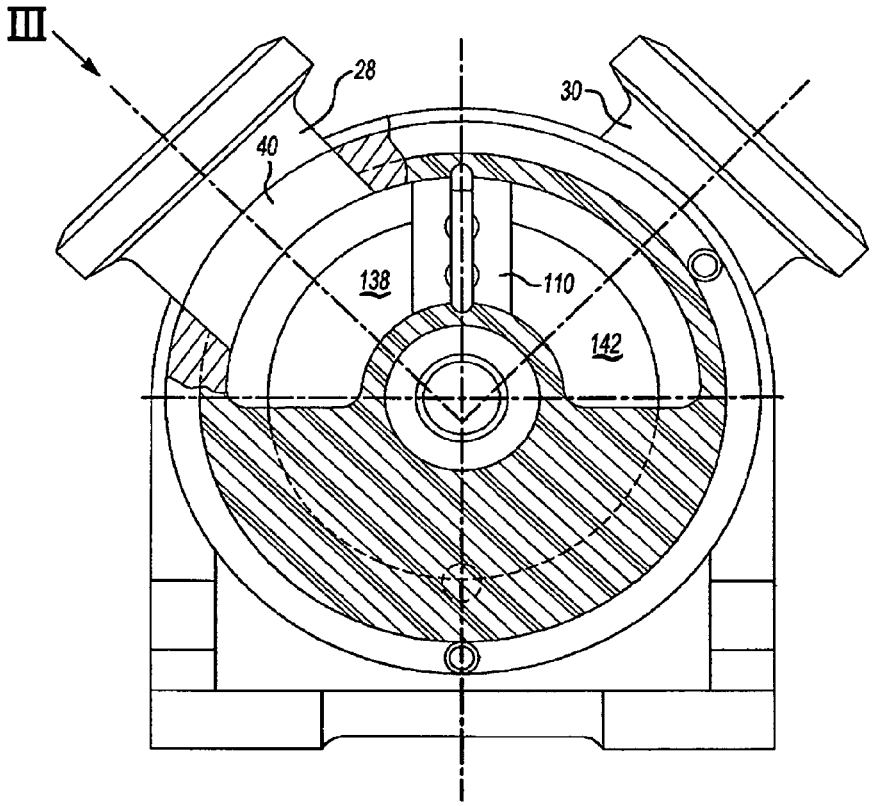
FIG. 2 is a front elevation view, partially in a section along II-II, of the pump shown in FIG. 1.

Referring to FIGS. 2, 4, 5, one can see that the pump 4 comprises an inlet chamber 138 (adjacent the first pipe socket 28, the opening 40 and the inlet port 68), thereafter a substantially semi-circular channel 140, thereafter an outlet chamber 142 (adjacent the outlet port 70 and the opening 40 and the pipe socket 30). The inlet chamber 138 and the outlet chamber 142 have a larger axial dimension than the channel 140. The inlet chamber 138 and the outlet chamber 142 are separated from each other by the "scraper 110 plus guide 92 sandwich". The outer edge surface 122 of the scraper 110 contacts the inner surface of the stator 42, and the concave (cf. FIG. 9) inner edge surface 144 of the scraper 110 contacts the two walls 54 of the stator 42.

The stator 42 and the scraper 110 are preferably made of Polyamide. Polyamide having the designation "Polyamide 12" ist particularly good for the stator 42, "Polyamide 6" is particularly good for the scraper 110.

The stator 42 can be produced by a moulding process, including the grooves 78 for the sealing members 72, 74 and including the grooves 96, 98, 100, 102, 104 for the edge zones 108 of the guide 92. The scraper 110 can be manufactured by a moulding process too, but in this case machining in particular the slots 112, 120, 124 is more advisable.

If, as an alternative, the pump 4 is designed as not having a housing 20 accommodating the stator 42, one may simply secure the first stator member 44 and the second stator member 46 to each other by any suitable means, for example and preferably by a number of tension bolts distributed along the outer cylindrical surface of the stator 42 and extending in axial direction. Such tension bolts may have end portions that engage the outer front faces of the first and second stator members 44 and 46. The pipe sockets 28 and 30 need to be secured to the stator 42. A preferred option would be to provide each pipe socket 28 and 30 with a, for example circular, flange, which is secured to a mating plane face provided at the outside of the stator 42. It is possible to seal the respective pipe socket 28 or 30, respectively, against the stator 42 either by using the outer cylindrical surface of the pipe socket and the cylindrical surface of the inlet port 68 or the outlet port 70 or by using the contact plane between the flange of the pipe socket and the mating plane face of the stator 42.

One will appreciate that the pump of this invention can be manufactured at relatively low cost. The number of parts is small, not all parts require machining, and especially with respect to the housing 20 few and uncomplicated machining is required only.

A typical amplitude of the undulating movement of the web 12 of the disk 10 is 20 mm.

Figure 10:
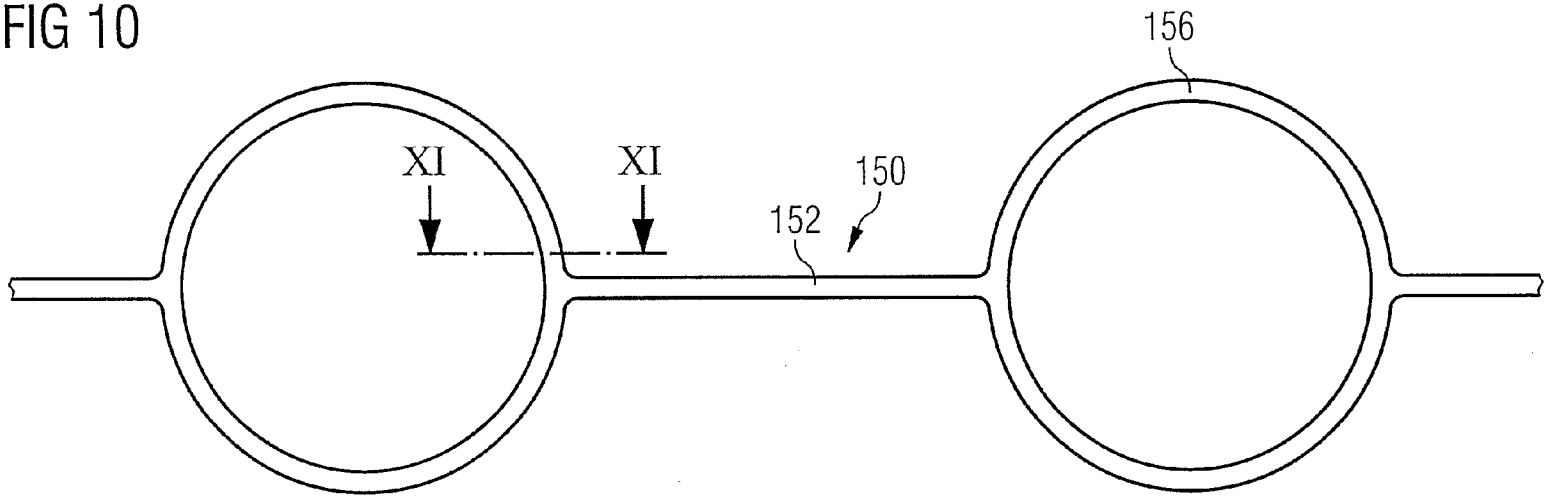
FIG. 10 shows a unitary moulded sealing member, developed in the drawing plane.
Figure 11:
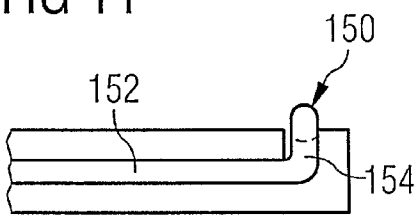
FIG. 11 shows a detail of the sealing member of FIG. 10, in front elevation view.

FIG. 10 shows a unitary moulded sealing member 150 which may be used instead of the two O-rings 72, 74. The modification as compared to the first embodiment described hereinbefore, is to unify those portions of the O-rings 72, 74 where they extend in parallel (i.e. the portions where there are no inlet port 68 or outlet port 70) into one strand 152 and to place that strand into a pair of grooves provided in the first and second abutment areas 64, 66. At both ends of each of the abutment areas 64,66, the unitary moulded sealing member 150 has a step 154 (cf FIG. 11) as a transition to the larger diameter grooves provided, as in the first embodiment, in the outer surface of the circumferential wall of the stator 42 at close distance to the inlet port 68 and the outlet port 70.

An alternative unitary moulded sealing member 150 looks exactly as shown in FIG. 10, but there is no step 154. The circular sections 156 would be located in grooves provided in the walls of the inlet and outlet ports. The circular sections 156 would engage the outer cylindrical surfaces of the pipe sockets 28 and 30.

The description has demonstrated that the locations of the sealing members 72, 74 or 150 are so close to chambers 138, 142/channel 140 filled with material to be pumped, that clean-in-place (CIP) is possible in an easy and very efficient way. Any cleaning liquid will readily reach the sealing members 72, 74 or 150 within a short time. It will rarely be necessary to disassemble the pump 4 for cleaning purposes.

Figure 12:
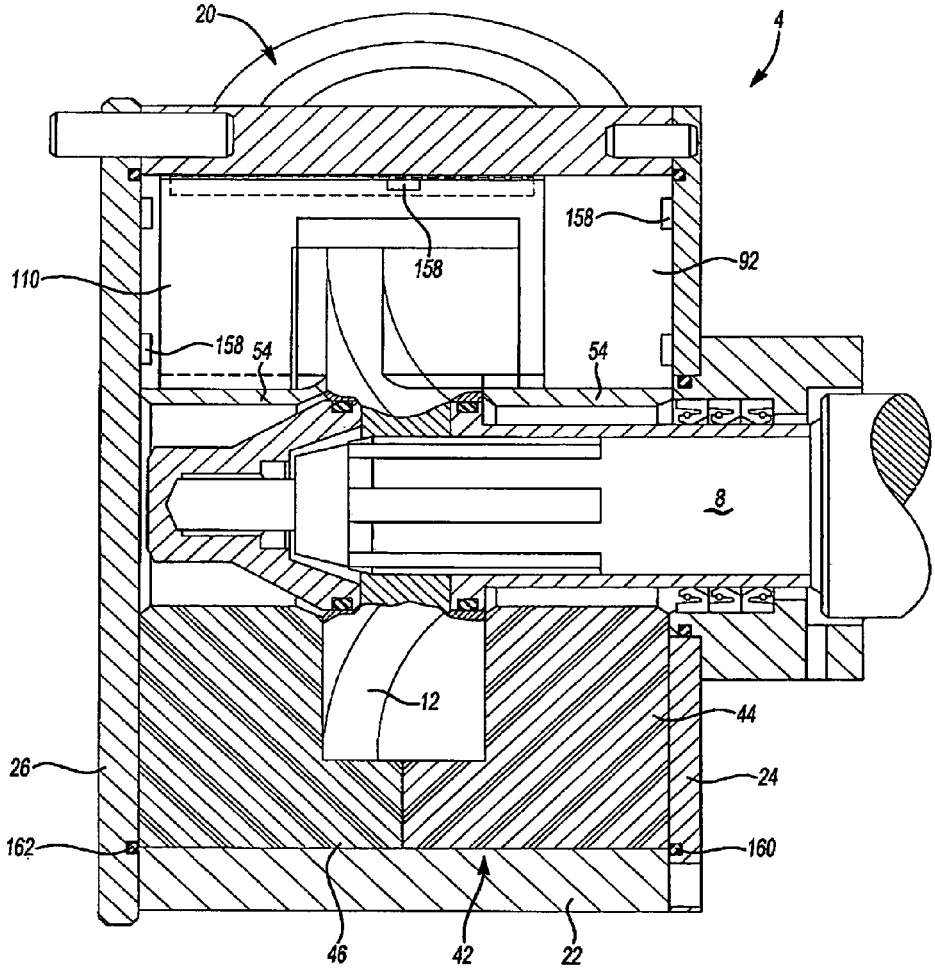
FIG. 12 shows the pump part proper of a second embodiment of the pump, in axial section analogously to FIG. 4.

FIG. 12 shows the pump part proper of a second embodiment of the pump of the invention. The pump part proper shown in FIG. 12 is an alternative to the pump part proper shown in FIG. 4. Like elements have the same reference numerals as in FIG. 4.

The significant differences as compared to the embodiment of FIG. 4 are the following:

The stator members 44 and 46 are not cup shaped. Those portions being above the cylindrical walls 54 in the embodiment of FIG. 4, have been "cut off". The guide 92 is directly fixed in the housing 20, without an interdisposed stator portion 42. There are two sealing rings 160 and 162, each provided between a front face of the cylindrical tube 22 and one of the end plates 24 and 26. There is no sealing member between the two stator members 44 and 46 and no sealing member between the stator members 44, 46 and the housing 20.

The guide 92 has substantially the same configuration as in the embodiment of FIG. 4. As shown in FIG. 12, the two front edge surfaces are plane and simply abut the end plates 24 and 26, respectively. The radially outer edge surface of the guide 92 is convex and simply abuts the inner circumference of the housing 20. It is stressed, however, that one unitary sealing member or three sealing members might be provided to provide for a more perfect sealing in those three contact areas.

The guide 92 is fixed in the housing 20 by six pairs of pin heads 158. Six pin heads 158 that are located in front of the guide 92 in FIG. 12, are shown in FIG. 12. The remaining six pin heads 158 are behind the guide 92 in FIG. 12. The pin heads 158 may be wider than the pin shafts and may be axially press-fitted or screwed into the end plates 24 and 276 and radially press-fitted or screwed into the cylindrical tube 22, respectively.

The scraper 110 is designed as in FIG. 4 and co-operates with the guide 92 in the same way as with the embodiment of FIG. 4.

As an alternative, with the embodiment of FIG. 12 the guide 92 may be fixed to the housing 20 by three of its edge zones resting in grooves of the end plates 24 and 26 and of the cylindrical tube 22. This would constitute a fixation of the guide 92 analogously to the embodiment of FIG. 4, but now directly to the housing rather than indirectly via the fixation in the stator 42 shown in FIG. 4. The fixation of the guide 92 for example by pairs of pin heads 158 as it can be seen in FIG. 12, evidently is easier to manufacture than machining grooves into the end plates 24, 26 and into the cylindrical tube 22.

As an alternative, the shaft 8 may be supported by slide bearings in the stator 42 rather than in the support part 6.

As a typical example, the pump of the invention may be designed for a counter-pressure of 10 bar (or even higher) and a volume rate of up to 90,000 l/h (Liters per hour).

The invention claimed is:

1. A rotary displacement pump, comprising:

a housing;

a stator fixed in said housing;

a rotor including a shaft portion and a radially protruding web having a configuration of and undulatory disk;

a scraper having an engagement slot of predetermined radial height and predetermined axial width, the engagement slot engaging said protruding web of said rotor;

a guide of said scraper, the guide generally having a configuration of a recessed plate and being at least one of directly or indirectly fixed in said housing, wherein the guide retains said scraper in a circumferential direction and allows said scraper a reciprocating movement in a substantially axial direction;

said scraper, including a first groove having a predetermined depth and extending along its radially outer edge surface, and a second groove and a third groove each having a predetermined depth and extending in radial direction along one front edge surface and along another front edge surface, respectively, of said scraper, said first, second and third grooves being designed such that they accommodate a portion of said guide and allow said reciprocating movement of said scraper in said substantially axial direction;

and said housing together with said stator and together with said scraper defining an inlet chamber, having an inlet port, of said pump, an outlet chamber, having an outlet port, of said pump, and a channel extending from said inlet chamber to said outlet chamber, said scraper forming a partition between said inlet chamber and said outlet chamber, and said web of said rotor being rotatable through said inlet chamber, said channel, said outlet chamber and said engagement slot of said scraper.

2. The pump of claim 1, wherein said guide is fixed in said housing by several pin heads engaging an edge zone of said guide.

3. The pump of claim 1, wherein said stator is made of plastic.

4. The pump of claim 3, wherein said stator is made of polyamide.

5. The pump of claim 1, wherein said stator comprises two stator members abutting in a plane that is perpendicular to a rotor axis.

6. The pump of claim 1, wherein said housing is substantially formed of a cylindrical tube and two circular end plates.

7. The pump of claim 1, wherein said housing is mainly made of stainless steel.

8. The pump of claim 1, wherein said guide is made of metal.

9. The pump of claim 1, wherein said scraper generally has a plate-like configuration having said engagement slot.

10. The pump of claim 1, wherein said scraper is made of plastic.

11. The pump of claim 10, wherein said scraper is made of polyamide.

12. The pump of claim 1, wherein said rotor is supported by bearings positioned besides said housing, and said rotor extends into said stator in cantilever fashion.

13. The pump of claim 12, wherein said pump comprises a support part accommodating said bearings, and said housing is secured to said support part.

* * * * *